US006463623B2

(12) United States Patent
Ahn et al.

(10) Patent No.: US 6,463,623 B2
(45) Date of Patent: Oct. 15, 2002

(54) POWER BRUSH ASSEMBLY FOR VACUUM CLEANERS

(75) Inventors: Jun Ho Ahn, Seoul; Jin Soo Park, Inchun-si, both of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/832,847

(22) Filed: Apr. 12, 2001

(65) Prior Publication Data

US 2002/0032948 A1 Mar. 21, 2002

(30) Foreign Application Priority Data

Sep. 15, 2000 (KR) ..... 00-54281

(51) Int. Cl.[7] ..... A47L 9/04

(52) U.S. Cl. ..... 15/389; 15/364; 15/377; 310/15; 310/266

(58) Field of Search ..... 15/364, 380, 389, 15/377; 310/12, 15, 266

(56) References Cited

U.S. PATENT DOCUMENTS 1,056,129 A * 3/1913 Sladinska ..... 15/389
1,940,954 A * 12/1933 Kohler ..... 15/364
2,253,289 A * 8/1941 Demaree et al. ..... 15/364
2,253,309 A * 8/1941 Smellie ..... 15/364
2,421,235 A * 5/1947 Basinger ..... 15/377
4,050,112 A * 9/1977 Saxon ..... 15/389
4,945,269 A * 7/1990 Kamm ..... 310/12
5,789,837 A * 8/1998 Shin et al. ..... 310/15
5,901,411 A * 5/1999 Hato et al. ..... 15/377
6,215,206 B1 * 4/2001 Chitayat ..... 310/12
6,255,749 B1 * 7/2001 Aoshima et al. ..... 310/254

* cited by examiner

*Primary Examiner*—Theresa T. Snider
(74) *Attorney, Agent, or Firm*—Birch, Stewart, Kolasch & Birch, LLP

(57) ABSTRACT

A power brush assembly for vacuum cleaners is disclosed. In the power brush assembly, a casing is set in the suction part of a vacuum cleaner and defines a suction nozzle used for sucking dust-laden air under pressure into the suction part of the vacuum cleaner. A power brush is set within the casing such that the brush is rotatable and reciprocable to the left and right. This power brush is used for brushing dust and impurities on a target surface. A drive motor generates a rotating force for allowing the power brush to rotate and reciprocate to the left and right within the casing. A power transmission mechanism connects the drive motor to the power brush so as to transmit the rotating force of the drive motor to the power brush. In this power brush assembly, the brush body of the power brush performs a linear reciprocating action in addition to a rotating action, and so the brush assembly effectively and actively brushes a target surface at areas corresponding to the gaps between opposite ends of the brush body and opposite sidewalls of the casing. This brush assembly thus improves the dust cleaning effect of a vacuum cleaner.

9 Claims, 3 Drawing Sheets

POWER BRUSH ASSEMBLY FOR VACUUM CLEANERS

BACKGROUND OF THE INVENTION

1. Field of the Invention

The present invention relates to a power brush assembly for vacuum cleaners and, more particularly, to a power brush assembly designed to perform a linear reciprocating action in addition to a rotating action, thus improving a dust cleaning effect of a vacuum cleaner.

2. Description of the Prior Art

FIG. 1 is a perspective view of a conventional vacuum cleaner. As shown in the drawing, the conventional vacuum cleaner comprises a suction part 200, which is provided at the lower portion of a body 100 and is used for sucking dust-laden air from a target surface using a suction force of a motor-operated suction fan 300. A dust filter bag 400 is set within the body 100 at a predetermined position, and filters the dust-laden air to collect dust therein. An air guide passage 500 is provided at the body 100 for guiding the dust-laden air from the suction part 200 to the dust filter bag 400 within the body 100. A power brush assembly 600 is set within the suction nozzle of the suction part 200, and actively brushes the target surface to more effectively suck dust and impurities from the target surface into the suction part 200.

FIG. 2 is a view, showing the construction of a conventional power brush assembly for vacuum cleaners.

As shown in FIG. 2, the conventional power brush assembly comprises a casing 104 defining the suction nozzle 102, through which dust-laden air is sucked under pressure into the suction part of a vacuum cleaner. A power brush 106 is rotatably set within the casing 104, and brushes dust and impurities on a target surface so as to allow the dust and impurities to be more effectively sucked along with pressurized air from the target surface into the suction part. A drive motor 108 is set on the interior surface of the casing 104, and generates a rotating force for the power brush 106. The power brush assembly also comprises a power transmission mechanism used for transmitting the rotating force of the drive motor 108 to the power brush 106.

In the above conventional power brush assembly, the power brush 106 has a longitudinal roller-shaped body, with a plurality of spiral ridges regularly formed around the external surface of the roller-shaped body. A great number of brushing projections 112 are formed along each spiral ridge of the power brush 106, and actively brush a target surface to separate dust and impurities from the surface during a rotating action of the brush 106. Two rotating shafts 110 are formed at opposite ends of the roller-shaped body of the power brush 106, and rotatably hold the brush 106 to opposite sidewalls of the casing 104, with a sleeve bearing 114 formed on the interior surface of each sidewall of the casing 104 at a position around each rotating shaft 110 and rotatably holding each shaft 110 on the casing 104.

The power transmission mechanism of the conventional power brush assembly comprises a drive pulley 118, which is fixed to the motor shaft 116 of the drive motor 108 and is rotatable along with the motor shaft 116 in the same direction. A driven pulley 120 is mounted to one end of the power brush 106, while a transmission belt 124 is wrapped around the drive and driven pulleys 118 and 120 to transmit the rotating force of the drive pulley 118 to the driven pulley 120.

When the drive motor 108 of the conventional power brush assembly is electrically activated, the drive motor 108 is rotated in one direction. The rotating force of the motor 108 is transmitted to the power brush 106 through the drive pulley 118, the belt 124 and the driven pulley 120, thus rotating the brush 106 in the same direction and allowing the brush 106 to actively brush a target surface to separate dust and impurities from the target surface.

However, the conventional power brush assembly is problematic in that it only performs a rotating action around its rotating shafts 110, and so the brush assembly cannot totally brush a target surface at areas corresponding to the gaps between the opposite ends of the brush 106 and the sidewalls of the casing 104. Therefore, it is almost impossible for the conventional brush assembly to separate dust or impurities from said areas, thus reducing the dust cleaning effect of a vacuum cleaner.

SUMMARY OF THE INVENTION

Accordingly, the present invention has been made keeping in mind the above problems occurring in the prior art, and an object of the present invention is to provide a power brush assembly for vacuum cleaners, which is designed to perform a linear reciprocating action in addition to a rotating action, thus effectively brushing the areas of a target surface corresponding to the gaps between opposite ends of its brush and the sidewalls of the casing and improving the dust cleaning effect of a vacuum cleaner.

In order to accomplish the above object, the present invention provides a power brush assembly for vacuum cleaners, comprising: a casing set in the suction part of a vacuum cleaner and defining a suction nozzle used for sucking dustladen air under pressure into the suction part of the vacuum cleaner; a power brush set within the casing such that the brush is rotatable and reciprocable to the left and right within the casing, the power brush being used for brushing dust and impurities on a target surface; a drive motor generating a rotating force for allowing the power brush to rotate and reciprocate to the left and right; and a power transmission mechanism connecting the drive motor to the power brush and transmitting the rotating force of the drive motor to the power brush.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
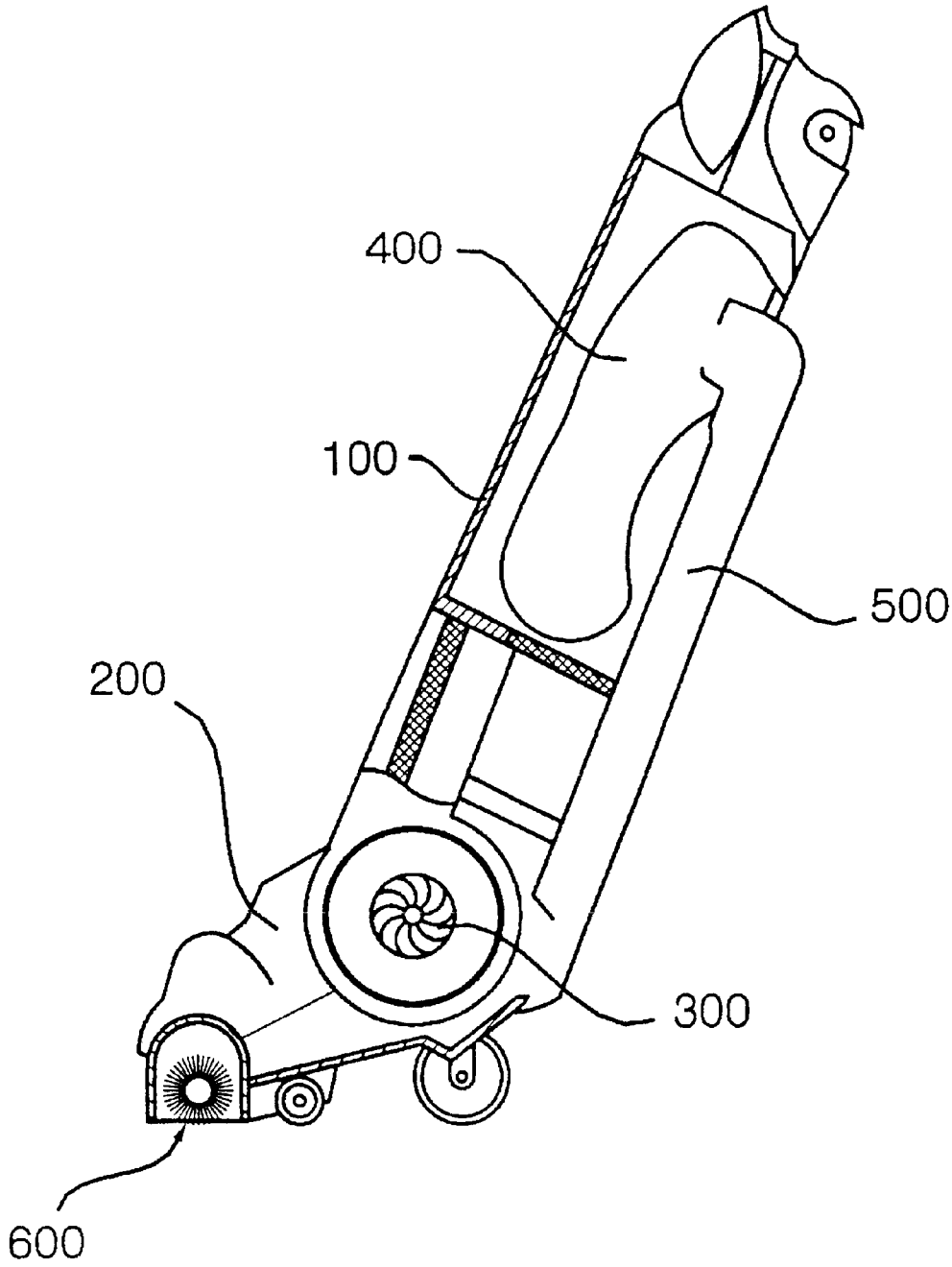
FIG.1(Prior Art)
FIG. 1 is a perspective view of a conventional vacuum cleaner.
Figure 2:
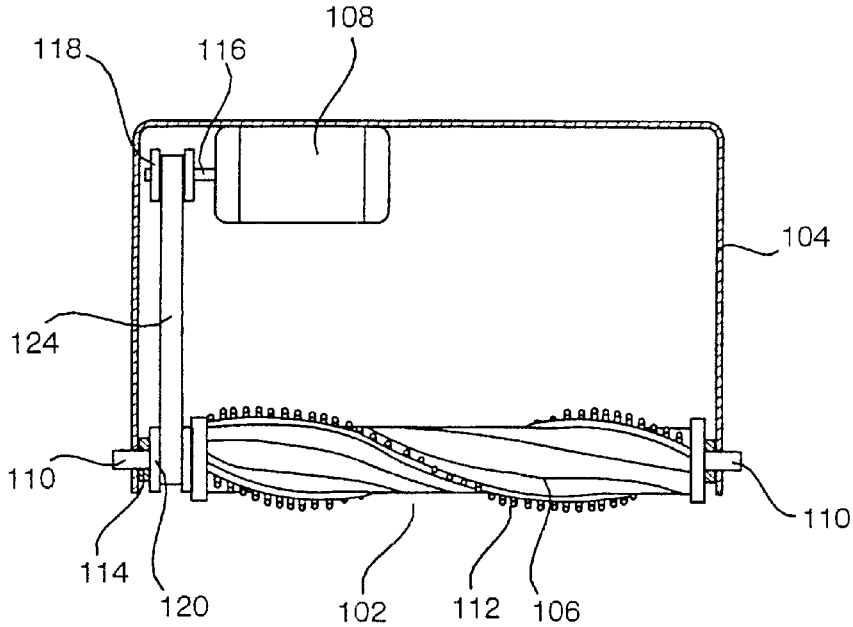
FIG.2(Prior Art)
FIG. 2 is a view, showing the construction of a conventional power brush assembly for vacuum cleaners.
Figure 3:
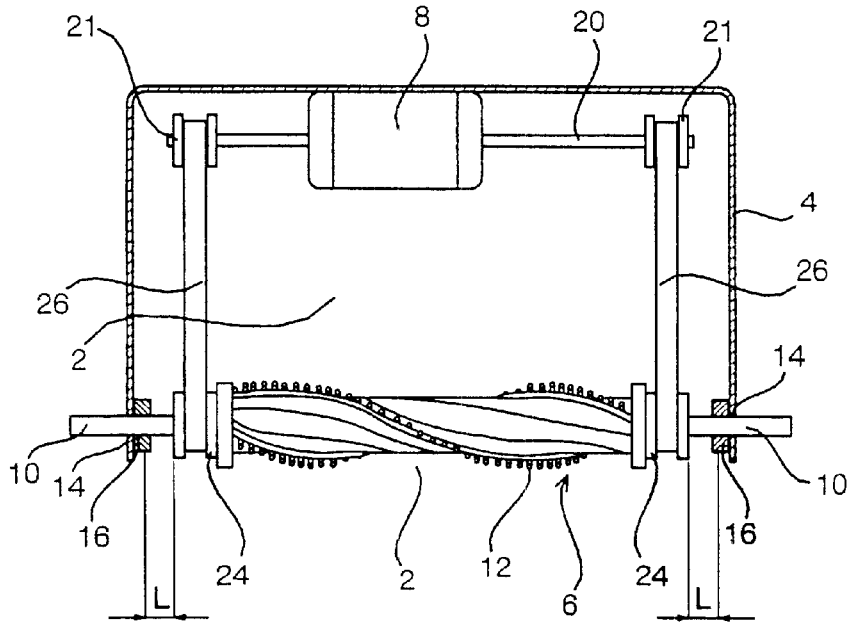
FIG. 3 is a view, showing the construction of a power brush assembly for vacuum cleaners in accordance with the primary embodiment of the present invention.

FIG. 3 is a view, showing the construction of a power brush assembly for vacuum cleaners in accordance with the primary embodiment of the present invention.

As shown in the drawing, the power brush assembly according to the primary embodiment of this invention comprises a casing 4, which is set in the bottom of the suction part of a vacuum cleaner and defines a suction nozzle 2 used for sucking dust-laden air under pressure into the suction part of the vacuum cleaner. A power brush 6 is set within the casing 4 such that the brush 6 is rotatable and reciprocable to the left and right within a predetermined range. This brush 6 brushes dust and impurities on a target surface so as to allow the dust and impurities to be more effectively sucked along with pressurized air from the target surface into the suction part. A drive motor 8 is set on the upper portion of the interior surface of the casing 4, and generates a rotating force for allowing the power brush 6 to rotate and reciprocate to the left and right. The power brush assembly of this invention also comprises a power transmission mechanism used for transmitting the rotating force of the drive motor 8 to the power brush 6.

In the above power brush assembly of the primary embodiment, the power brush 6 has a longitudinal roller-shaped brush body 12, with a plurality of spiral ridges regularly formed around the external surface of the roller-shaped brush body 12. A great number of brushing projections are formed along each spiral ridge of the brush body 12, and actively brush a target surface to separate dust and impurities from the surface during a rotating and reciprocating action of the brush body 12. Two rotating shafts 10 are formed at opposite ends of the roller-shaped brush body 12, and movably hold the brush body 12 to two bearing holes 14 formed at opposite sidewalls of the casing 4. A sleeve bearing 16 is formed on the interior surface of each sidewall of the casing 4 at a position around each bearing hole 14, and movably holds each rotating shaft 10 of the brush body 12 on the casing 4 while allowing the brush body 12 to be rotatable and reciprocable to the left and right within the casing 4.

In such a case, it is necessary to space each end of the brush body 12 from an associated sleeve bearing 16 of the casing 4 by a predetermined gap so as to allow the brush body 12 to be reciprocable to the left and right within the casing 4.

The power transmission mechanism of this power brush assembly comprises two drive pulleys 21, which are fixed to opposite ends of a motor shaft 20 of the drive motor 8 and are rotatable along with the motor shaft 20 in the same direction. Two driven pulleys 24 are mounted to opposite ends of the brush body 12, while a transmission belt 26 is wrapped around each drive pulley 21 and an associated driven pulley 24 to transmit the rotating force of the drive pulley 21 to the driven pulley 24.

Figure 4:
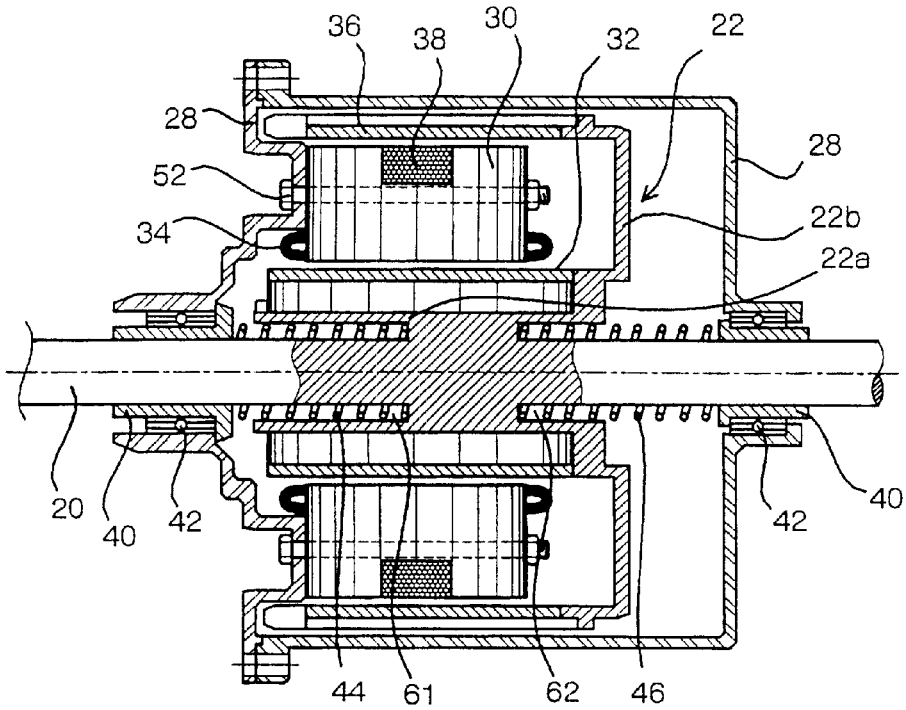
FIG. 4 is a sectional view of a drive motor used in the power brush assembly of the present invention.

FIG. 4 is a sectional view, showing the construction of the drive motor 8 used in the power brush assembly of the present invention. As shown in the drawing, the drive motor 8 comprises a motor housing 28, which is fixed to a predetermined position on the interior surface of the casing 4. The motor shaft 20 penetrates the housing 28 such that the shaft 20 projects from opposite sidewalls of the housing 28 at its opposite ends and is rotatable and reciprocable relative to the housing 28. A rotor frame 22 is integrated with the motor shaft 20 at a position within the housing 28, and so the shaft 20 is rotatable along with the frame 22. A cylindrical rotation magnet 32 is set around the inside portion of the rotor frame 22, while a cylindrical reciprocation magnet 36 is set around the outside portion of the rotor frame 22. A stator 30 is set between the two magnets 32 and 36 while being spaced apart from the two magnets 32 and 36. A coil is wound around the inside edge of the stator 30, thus forming a first stator core 34 selectively rotating the rotation magnet 32 in response to an application of electricity thereto. Another coil is wound around the outside edge of the stator 30, thus forming a second stator core 38 selectively moving the reciprocation magnet 36 to the left and right in response to an application of electricity thereto.

The above rotor frame 22 comprises a sleeve body 22*a* having a diameter larger than that of the motor shaft 20, and a disc body 22*b* extending outward from the sleeve body 22*a* in a radial direction.

The stator 30 is fixed to the housing 28 using locking bolts 52.

A sleeve bearing 40 is set at the junction of the motor shaft 20 and each sidewall of the housing 28, with a radial bearing 42 set outside the sleeve bearing 40. In such a case, the sleeve bearings 40 hold a linear movement of the motor shaft 20 relative to the housing 28, while the radial bearings 42 hold a rotating action of the shaft 20 relative to the housing 28. The motor shaft 20 is thus rotatable and reciprocable to the left and right relative to the housing 28.

An elastic support means is installed at a predetermined position around the motor shaft 20 for allowing an elastic reciprocating action of the motor shaft 20.

The elastic support means comprises a first coil spring 44 and a second coil spring 46. The first coil spring 44 is set within a first annular spring seat 61 defined between the left-hand part of the sleeve body 22*a* and the shaft 20, and is stopped by the first sleeve bearing 42 at its outside end. The second coil spring 46 is set within a second annular spring seat 62 defined between the right-hand part of the sleeve body 22*a* and the shaft 20, and is stopped by the second sleeve bearing 42 at its outside end.

The power brush assembly of this invention is operated as follows:

When the first stator core 34 is electrically activated for performing a cleaning operation, the rotator frame 22 is rotated by the rotation magnet 32, thus rotating the motor shaft 20 in the same direction. The two drive pulleys 21 of the shaft 20 are thus rotated, and so the rotating force of the shaft 20 is transmitted to the power brush 6 through the two drive pulleys 21, the two belts 26 and the two driven pulleys 24. Therefore, the brush body 12 of the power brush 6 is rotated in a direction.

On the other hand, the second stator core 38 is electrically activated, simultaneous with the electric activation of the first stator core 34, and so the rotator frame 22 and the motor shaft 20 are moved to the left and right by the reciprocation magnet 36. In such a case, the motor shaft 20 is moved to the left and right within a predetermined reciprocating range while being elastically biased by the first and second coil springs 44 and 46.

Due to the opposite directional movement of the shaft 20, the two drive pulleys 21 of the shaft 20 are moved in the same directions, and so the reciprocating force of the shaft 20 is transmitted to the power brush 6 through the two drive pulleys 21, the two belts 26 and the two driven pulleys 24. Therefore, the brush body 12 of the power brush 6 is moved to the left and right.

In the primary embodiment, each of the two rotating shafts 10 of the power brush 6 has a sufficient length capable of allowing the brush body 12 to be movable to the left and right within a desired range relative to the casing 4. In addition, the brush body 12 is set in the casing 4 while leaving sufficient gaps between the opposite ends of the brush body 12 and the opposite sidewalls of the casing 4, thus allowing the brush body 12 to be movable to the left and right within a desired sufficient range during a cleaning operation. In the power brush assembly of this primary embodiment, the gap between each drive pulley 21 and an associated driven pulley 24 is sufficiently short, and so the reciprocating action of the two drive pulleys 21 is almost completely transmitted to the two driven pulleys 24 without failure. It is thus possible to accomplish a desired operational reliability of the power brush 6 during a reciprocating action of the brush 6.

Figure 5:
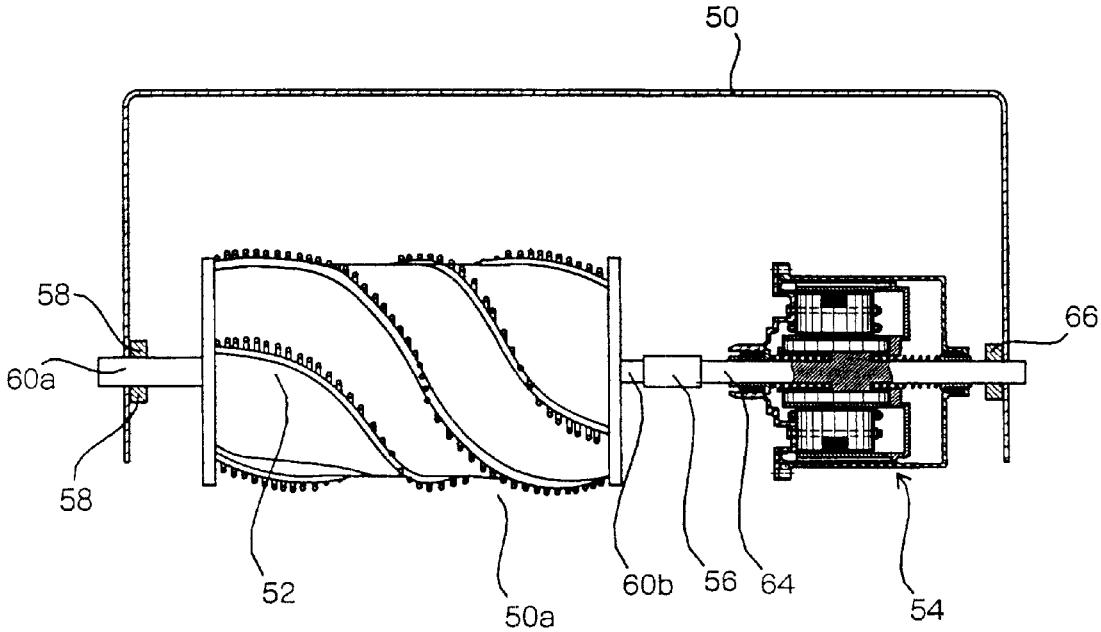
FIG. 5 is a view, showing the construction of a power brush assembly for vacuum cleaners in accordance with the second embodiment of the present invention.

FIG. 5 is a view, showing the construction of a power brush assembly for vacuum cleaners in accordance with the second embodiment of the present invention.

In the second embodiment, the power brush assembly comprises a casing 50, which is set in the bottom of the suction part of a vacuum cleaner and defines a suction nozzle 50*a* used for sucking dust-laden air under pressure into the suction part of the vacuum cleaner. A power brush 52 is set within the casing 50 such that the brush 52 is rotatable and reciprocable to the left and right within a predetermined range. This brush 52 brushes dust and impurities on a target surface so as to allow the dust and impurities to be more effectively sucked along with pressurized air from the target surface into the suction part. A drive motor 54 is coaxially coupled to the power brush 52, and generates a rotating force for allowing the power brush 52 to rotate and reciprocate to the left and right. The power brush assembly of this invention also comprises a coupling 56, which coaxially connects the power brush 52 to the drive motor 54.

In the power brush assembly of the second embodiment, the power brush 52 has first and second rotating shafts 60*a* and 60*b* at opposite ends thereof. The first rotating shaft 60*a* of the power brush 52 is movably fitted into the first sleeve bearing 58 formed at one sidewall of the casing 50 such that the shaft 60*a* is rotatable and linearly movable to the left and right relative to the casing 50. The second rotating shaft 60*b* of the power brush 52 is coupled to the motor shaft 64 of the drive motor 54 through the coupling 56.

The construction and operation of the drive motor 54 according to this second embodiment remains the same as that described for the primary embodiment. That is, the motor shaft 64 penetrates the motor housing such that the shaft 64 projects from opposite sidewalls of the motor housing at its opposite ends and are rotatable and reciprocable relative to the motor housing. The first end of the motor shaft 64 is movably fitted into the second sleeve bearing 66 formed at the other sidewall of the casing 50 such that the shaft 64 is rotatable and linearly movable to the left and right relative to the casing 50. On the other hand, the second end of the shaft 64 is coupled to the second rotating shaft 60*b* of the power brush 52. In such a case, the second end of the motor shaft 64 is coaxially aligned with the second rotating shaft 60*b* of the power brush 52, and is coupled to said rotating shaft 60*b* through the coupling 56.

In order to prevent an undesired interference between the power brush 52 and the casing 50 during a reciprocating action of the brush 52, both the first rotating shaft 60*a* of the brush 52 and the first end of the motor shaft 64, fitted into the first and second sleeve bearings 58 and 66 of the casing 50, have sufficient lengths capable of allowing the brush 52 to be smoothly movable to the left and right within the casing 50 without causing any interference with the casing 50.

When the drive motor 54 of the power brush assembly according to the second embodiment is electrically activated, the motor shaft 64 rotates and reciprocates to the left and right. Therefore, the power brush 52, coupled to the motor shaft 64 through the coupling 56, rotates and reciprocates in the same directions as that of the motor shaft 64 to more actively brush a target surface.

As described above, the present invention provides a power brush assembly for vacuum cleaners. In this power brush assembly, the brush body is designed to perform a linear reciprocating action in addition to a rotating action, and so the brush assembly effectively and actively brushes a target surface at areas corresponding to the gaps between opposite ends of the brush body and opposite sidewalls of the assembly casing, thus improving the dust cleaning effect of a vacuum cleaner.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A power brush assembly for vacuum cleaners, comprising:

a casing set in a suction part of a vacuum cleaner and defining a suction nozzle used for sucking dust-laden air under pressure into said suction part of the vacuum cleaner;

a power brush set within said casing such that the brush is rotatable and reciprocable to the left and right, said power brush being used for brushing dust and impurities on a target surface;

a drive motor generating a force for allowing said power brush to rotate and reciprocate to the left and right; and a power transmission mechanism connecting said drive motor to said power brush and transmitting the rotating force of the drive motor to the power brush, wherein said drive motor comprises:

a motor shaft assembled with said casing such that the motor shaft is rotatable and reciprocable relative to the casing;

a rotor frame integrated with said motor shaft;

a rotation magnet and reciprocation magnet set at said rotor frame, said rotation magnet rotating the rotor frame and said reciprocation magnet moving the rotor frame to the left and right;

a stator positioned inside the rotor frame while being spaced apart from the rotation and reciprocation magnets;

a first stator core set on said stator and rotating said rotation magnet in response to an application of electricity thereto; and a second stator core set on said stator and moving said reciprocation magnet to the left and right in response to an application of electricity thereto.

2. The power brush assembly according to claim 1, wherein said rotor frame comprises a sleeve body integrated with the motor shaft and a disc body extending outward from an end of said sleeve body in a radial direction, with said rotation magnet set around an inside portion of said disc body, said reciprocation magnet set around an outside portion of said disc body, and said stator set between said rotation and reciprocation magnets.

3. The power brush assembly according to claim 2, wherein an annular spring seat is defined between each end of said sleeve body and the motor shaft, with a coil spring set within said annular spring seat.

4. The power brush assembly according to claim 1, wherein said rotor frame is movably set within a motor housing, and wherein said motor housing is fixed to an interior surface of said casing, and said stator is fixed to said motor housing.

5. The power brush assembly according to claim 4, wherein a sleeve bearing and a radial bearing are set at the junction of the motor shaft and each sidewall of said housing.

6. The power brush assembly according to claim 1, wherein said power brush comprises:

a cylindrical brush body, with a plurality of spiral ridges regularly formed around an external surface of the cylindrical brush body and a plurality of brushing projections formed along each of the spiral ridges and used for actively brushing a target surface to separate dust and impurities from said surface; and a first shaft formed at a first end of said cylindrical brush body, and a second shaft formed at a second end of said cylindrical brush body, said first and second shafts movably holding the brush body to first and second sleeve bearings provided at opposite sidewalls of said casing, respectively, such that the brush body is rotatable and reciprocable to the left and right within the casing, whereby each end of said brush body is spaced apart from the first and second sleeve bearings, thus allowing the brush body to be reciprocable to the left and right within the casing, and said power transmission mechanism connects the drive motor to the opposite ends of said brush body.

7. The power brush assembly according to claim 6, wherein said power transmission mechanism comprises:

a first drive pulley fixed to one end of said motor shaft of said drive motor, and a second drive pulley fixed to an opposite end of said motor shaft;

a first driven pulley mounted to one end of said brush body, and a second driven pulley mounted to an opposite end of said brush body; and a first transmission belt wrapped around said first drive pulley and said first driven pulley, and a second transmission belt wrapped around said second drive pulley and said second driven pulley.

8. The power brush assembly according to claim 1, wherein said drive motor is coaxially coupled to said power brush.

9. The power brush assembly according to claim 8, wherein said motor shaft of said drive motor is coaxially coupled to a rotating shaft of said power brush through a coupling.

* * * * *